US008186670B2

(12) United States Patent
Horiuchi

(10) Patent No.: US 8,186,670 B2
(45) Date of Patent: May 29, 2012

(54) SHEET SUPPLY APPARATUS

(75) Inventor: Haruhiko Horiuchi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 278 days.

(21) Appl. No.: 12/634,100

(22) Filed: Dec. 9, 2009

(65) Prior Publication Data

US 2010/0148418 A1 Jun. 17, 2010

(30) Foreign Application Priority Data

Dec. 11, 2008 (JP) ..... 2008-315904

(51) Int. Cl.
*B65H 1/22* (2006.01)

(52) U.S. Cl. ..... 271/162; 271/164

(58) Field of Classification Search ..... 271/162, 271/164, 145, 147, 157, 158, 159; 209/534; 194/350; 902/9, 11, 17; 232/43.1, 43.3, 232/43.4; 235/379
See application file for complete search history.

(56) References Cited

U.S. PATENT DOCUMENTS

| | | | | |
|---|---|---|---|---|
| 5,199,697 | A * | 4/1993 | Yamada et al. | 271/122 |
| 7,240,829 | B2 * | 7/2007 | Graef et al. | 235/379 |
| 7,870,997 | B2 * | 1/2011 | Eastman et al. | 235/379 |
| 2009/0084841 | A1 * | 4/2009 | Washington et al. | 235/379 |

FOREIGN PATENT DOCUMENTS

| | | | |
|---|---|---|---|
| JP | 2001-060278 | A | 3/2001 |
| JP | 2008-050053 | A | 3/2008 |

* cited by examiner

*Primary Examiner* — Jeremy R Severson
(74) *Attorney, Agent, or Firm* — Pillsbury Winthrop Shaw Pittman, LLP

(57) ABSTRACT

A sheet supply apparatus includes a supply portion with a sheet bundle supplied via an opening portion, a take-out portion to move the sheet bundle supplied to the supply portion to a take-out position and take out sheets one by one starting from a sheet on an uppermost surface of the sheet bundle, a first door with the opening portion arranged openably which is opened when the sheet bundle is supplied to the supply portion, a second door arranged openably on a middle position when the sheet bundle supplied to the supply portion moves to the take-out position, and a controller to control the first door and second door to open or close.

15 Claims, 11 Drawing Sheets

SHEET SUPPLY APPARATUS

CROSS-REFERENCE TO RELATED APPLICATION

This application is based upon and claims the benefit of priority from the prior Japanese Patent Application No. 2008-315904, filed on Dec. 11, 2008; the entire contents of all of which are incorporated herein by reference.

FIELD OF THE INVENTION

The present invention relates to a sheet processing apparatus for discriminating and sorting sheets such as marketable securities and more particularly to a sheet supply apparatus for supplying sheets.

DESCRIPTION OF THE BACKGROUND

A sheet processing apparatus for processing sheets such as marketable securities moves a sheet bundle supplied to a supply portion in a batch to a take-out position. The sheet bundle moved to the take-out position is taken out one by one starting from the sheet on the uppermost surface of the sheet bundle by a take-out apparatus and is conveyed to a sheet discriminator. The conveyed sheets are discriminated for the kind, authenticity, qualification, and conveying direction of the sheets by the sheet discriminator. On the basis of the discrimination results, the sheets are sorted and processed such as stacking and sealing.

This kind of apparatus is already put to practical use and the sheet supply apparatus installed in the supply portion of the sheet processing apparatus is equipped with an openable door. An operator opens the door, supplies a sheet bundle (for example, 1,000 sheets) to be processed, and closes the door. Then, if he performs the take-out start process such as pressing the take-out start button from the operating portion (console) of the sheet processing apparatus, the sheets are taken out one by one starting from the sheet on the uppermost surface of the sheet bundle at a predetermined interval.

The take-out apparatus used to take out sheets is often of an air suction method using a take-out rotor. To improve the processing efficiency, sheets must be taken out surely at high speed and the take-out by the take-out rotor is suited to this method (for example, refer to Japanese Patent Application Publication No. 2008-50053).

However, in the sheet supply apparatus described in Japanese Patent Application Publication No. 2008-50053, there are the problems (1) to (3) indicated below imposed.

(1) Problem of operability: When an operator lifts up a sheet bundle (about 1 kg for 1,000 sheets) and supplies the sheet bundle to the supply portion in the state that he sits on a chair, the supply portion is desirably arranged in the neighborhood of the sitting position. However, if the supply portion is excessively close to the sitting position, he consequently approaches the take-out apparatus installed in the neighborhood of the supply portion, and the noise of the take-out apparatus for taking out the sheets becomes loud, so that there is a limit to approaching, and the operability is apt to be sacrificed.

(2) Problem of safety: The sheet supply portion is equipped with a door, and the door can be opened during processing of the sheets, and the next sheet bundle can be supplied. Consequently, the sheets can be processed continuously and the operation rate of the sheet processing apparatus is improved. However, due to opening of the door, a problem of safety arises that there are possibilities that the operator may make contact with the operation portion such as the take-out apparatus for taking out the sheets.

(3) Problem of noise: In relation to (1) mentioned above, if the take-out apparatus is arranged in the neighborhood of the sitting position of the operator, the operability shown in (1) becomes better, though the operator hears directly the sound of the take-out apparatus for taking out the sheets and a problem of noisy arises.

SUMMARY OF THE INVENTION

The present invention was developed to solve the aforementioned problems and is intended to provide a sheet supply apparatus that the operability is improved by shortening the distance from the sitting position of an operator to the supply portion for supplying a sheet bundle, and the sheet supply portion is separated from the sheet take-out portion, and the take-out apparatus is arranged in the apparatus, thus the operator does not make contact with the operation portion even if the door is opened, and the noise can be prevented.

To achieve the above advantage, the aspect of the present invention is to provide a sheet supply apparatus comprising a supply portion with a sheet bundle supplied via an opening portion; a take-out portion to move the sheet bundle supplied to the supply portion to a take-out position and take out the sheets one by one starting from a sheet on an uppermost surface of the sheet bundle; a first door with the opening portion arranged openably to be opened when the sheet bundle is supplied to the supply portion; a second door arranged openably on a middle position when the sheet bundle supplied to the supply portion moves to the take-out position; and a controller to control the first door and the second door to open or close.

Further, to achieve the above advantage, the aspect of the present invention is to provide a sheet supply method comprising supplying a sheet bundle to a supply portion with a first door opened and loading the sheet bundle on a carrier; opening a second door closed and ensuring a movement path of the carrier; moving the carrier with the sheet bundle loaded to a take-out portion along the movement path; and closing the first door.

DETAILED DESCRIPTION OF THE INVENTION

Hereinafter, the embodiments of the present invention will be explained with reference to the accompanying drawings.

Figure 1:
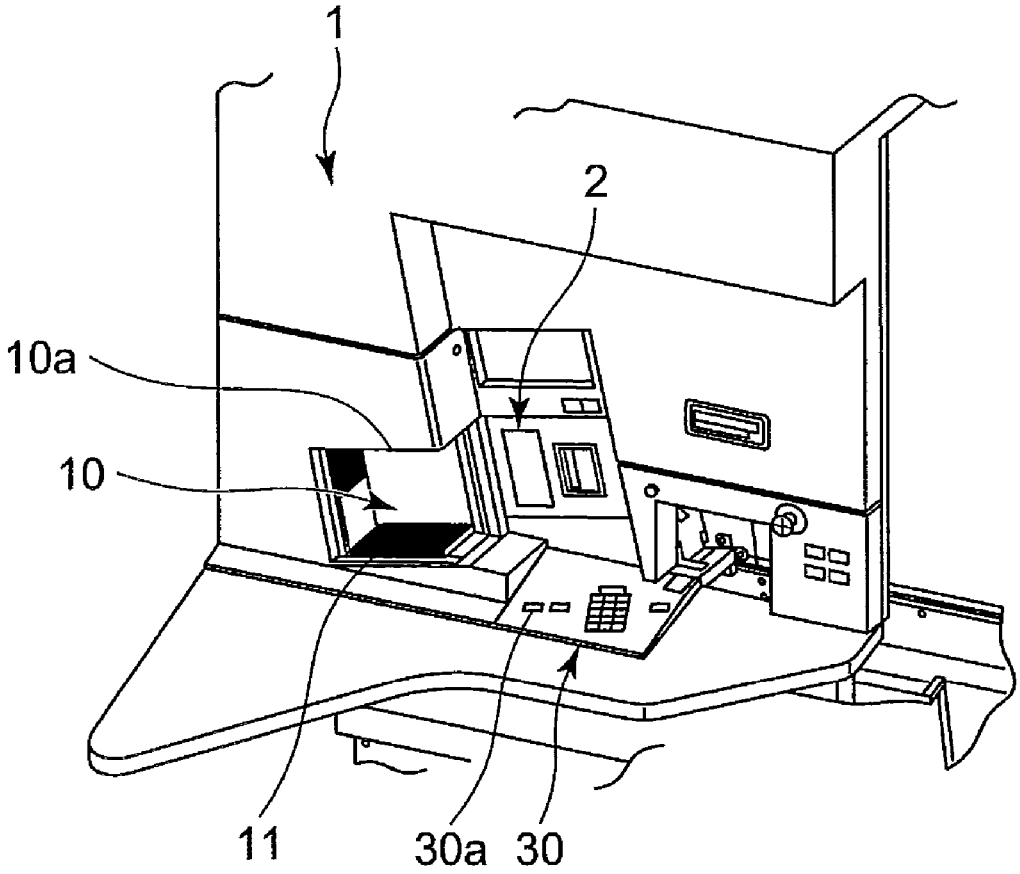
FIG. 1 is a perspective view showing the state before supplying a sheet bundle to the sheet supply portion relating to the embodiment of the present invention.
Figure 2A:
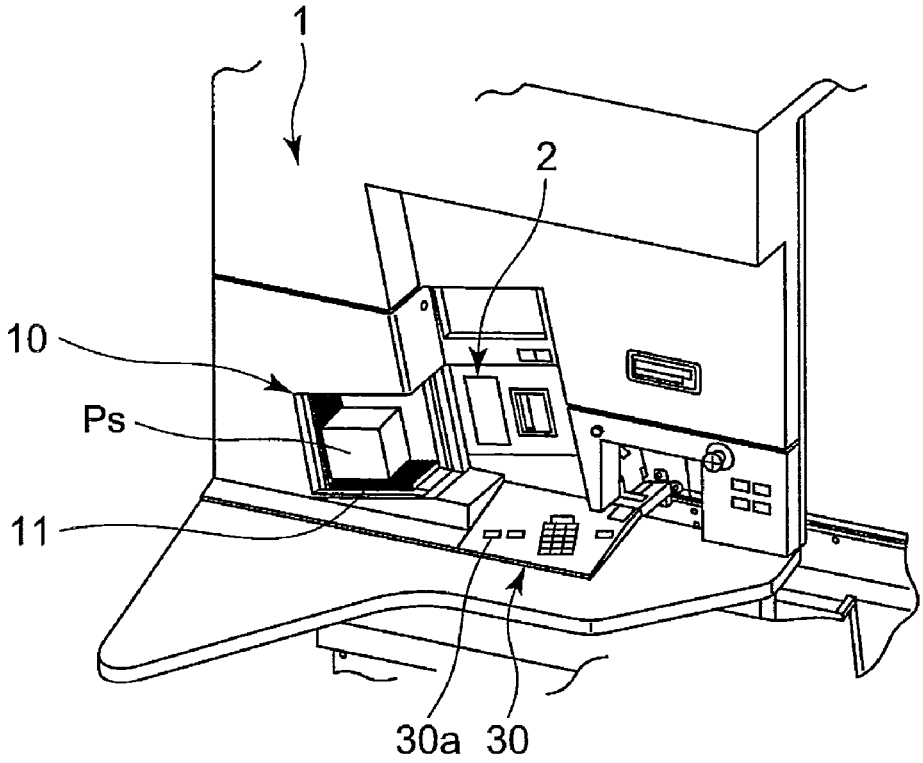
FIG. 2A is a perspective view showing the state that the sheet bundle is supplied to the sheet supply portion shown in FIG. 1.
Figure 2B:
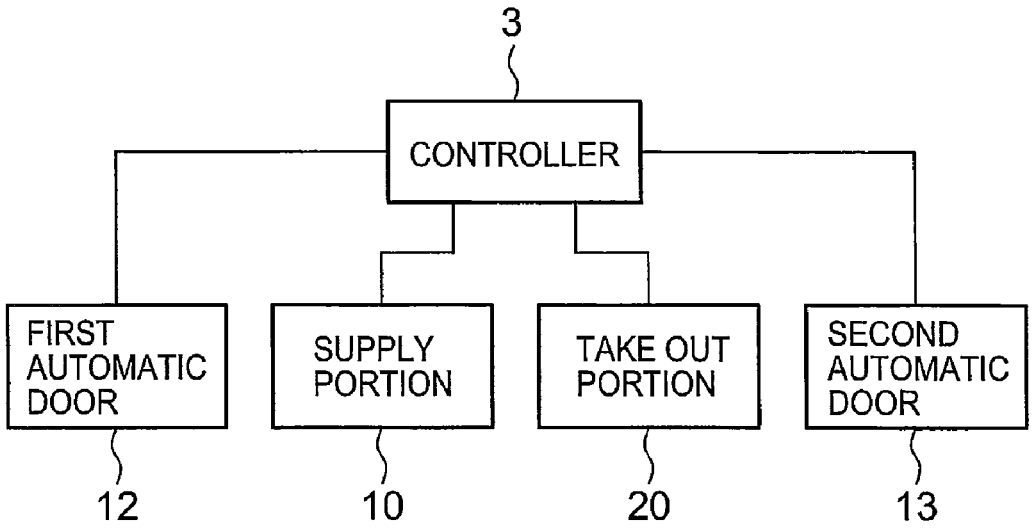
FIG. 2B is a block diagram showing control of the sheet supply apparatus.
Figure 3:
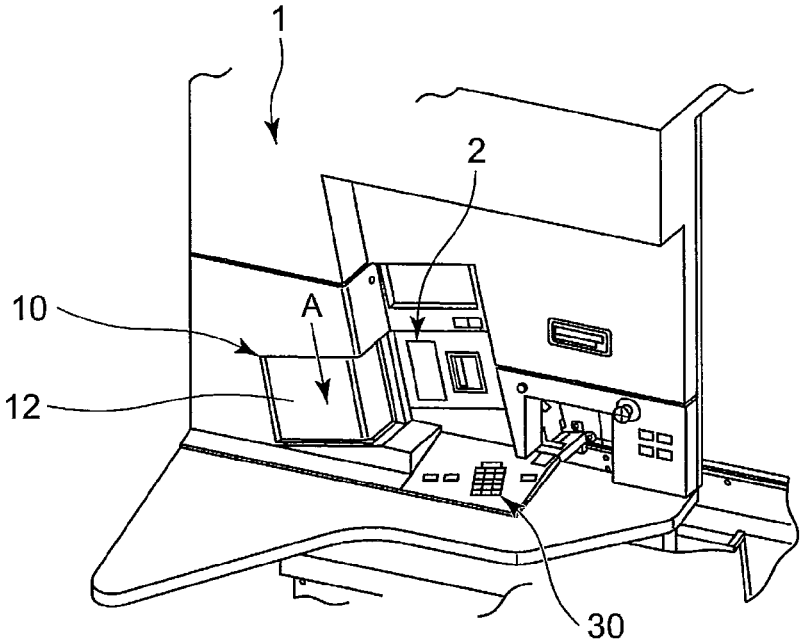
FIG. 3 is a perspective view showing the state that the take-out process of the sheet bundle is carried out by the sheet supply portion shown in FIG. 1.

FIGS. 1 to 3 are perspective views for explaining the operation of a sheet supply apparatus 2 loaded on a sheet processing apparatus 1 relating to the embodiments of the present invention. As shown in FIG. 2B, the sheet supply apparatus 2 is composed of a supply portion 10, a take-out portion 20, and a controller 3 for controlling the supply portion 10 and the take-out portion 20.

FIG. 1 is a perspective view showing the state before supplying a sheet bundle Ps to the sheet supply apparatus 2. If the initialization process of the sheet processing apparatus 1 is finished, the controller 3 opens a first automatic door 12 of the supply portion 10 in the state that a carrier 11 loading the sheet bundle Ps is positioned at the lowest portion and discloses an opening portion 10*a*. In this state, an operator enters the sheet bundle supply standby condition.

FIG. 2A shows the state that the sheet bundle Ps is loaded on the carrier 11 by the operator. If a take-out starting switch 30*a* installed in an operation portion 30 is pressed in this state, the controller 3 moves down the first automatic door 12 installed on the supply portion 10 in the direction of the arrow A drawn and closes the supply portion 10 (FIG. 3).

Figure 4:
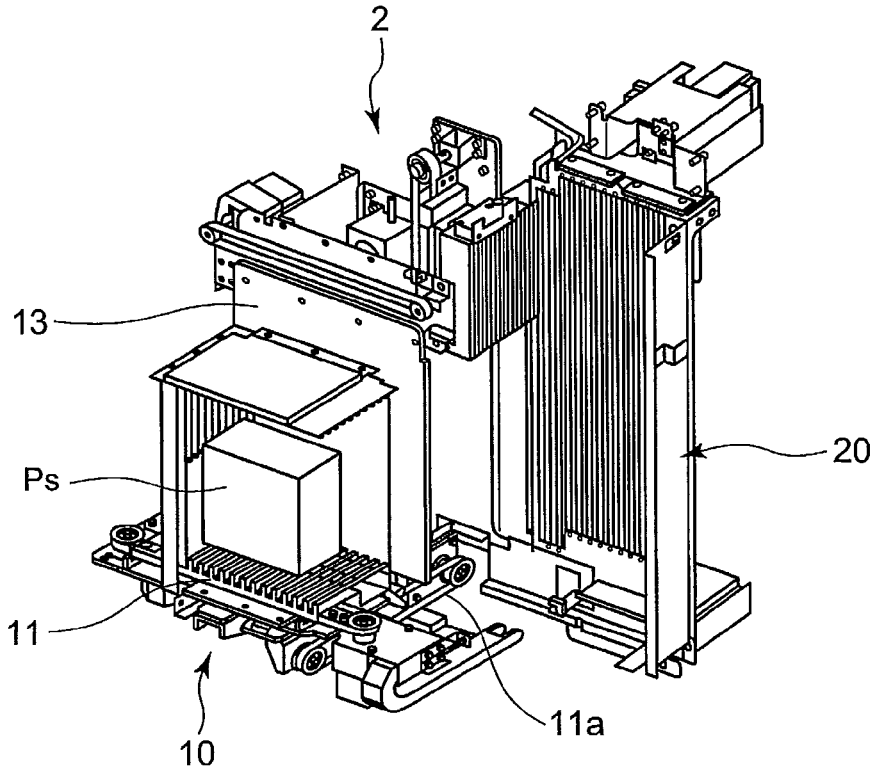
FIG. 4 is a perspective view showing the structure of the inside of the supply portion when the automatic door shown in FIG. 3 is closed.

FIG. 4 shows the sheet supply apparatus 2 of this embodiment. In the drawing, for easy understanding, the main bodies of the first automatic door 12 and the sheet processing apparatus 1 are excluded. Therefore, the internal condition of the sheet supply apparatus 2 immediately after the first automatic door 12 shown in FIG. 3 goes down and the supply portion 10 is closed is shown.

In the sheet supply apparatus 2, the supply portion 10 is arranged on the front side and the take-out portion 20 is arranged on the bask side (the rear side) thereof. The sheet bundle Ps supplied by the supply portion 10 is loaded on the carrier 11 and the carrier 11 moves from the supply portion 10 to the take-out portion 20 by a first moving structure 11*a*. By the movement, the sheet bundle Ps is transferred from the supply portion 10 to the take-out portion 20.

The first moving structure 11*a* is composed of a drive motor and a belt driven by the drive motor. Depending on the bill kind of the sheet bundle Ps supplied, the drive quantity is set. The details will be described later.

Hereinafter, the detailed operation of the carrier 11 will be explained.

Figure 5:
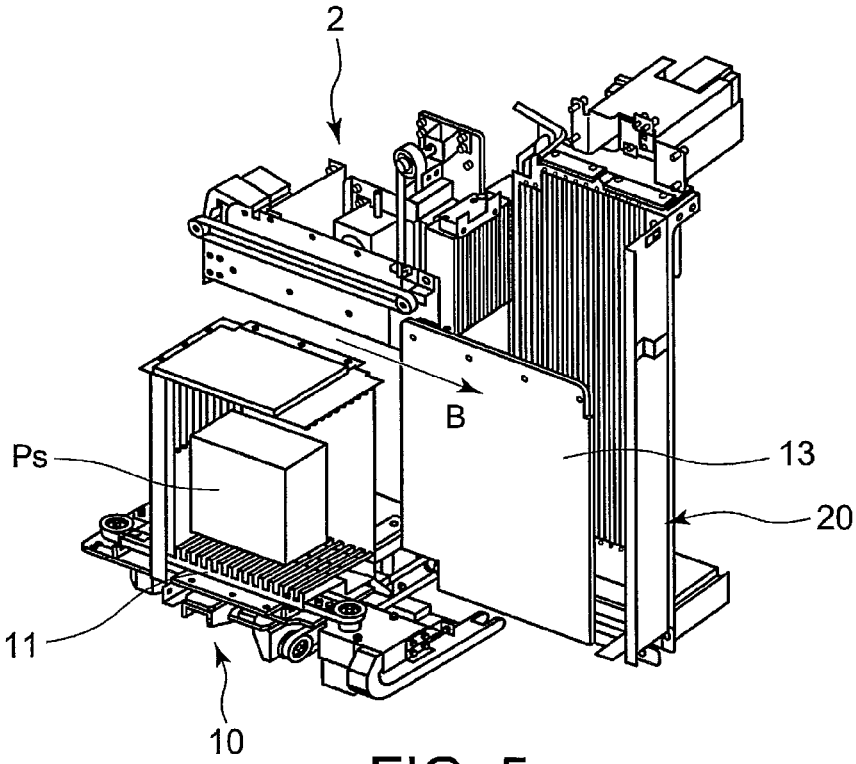
FIG. 5 is a perspective view showing the state that the automatic door (the second automatic door) arranged on the back side of the carrier shown in FIG. 4 moves in the direction of the arrow B drawn.

As shown in FIG. 5, the controller 3 moves a second automatic door 13 arranged on the back side of the carrier 11 in the direction of the arrow B drawn. The controller 3 opens the second automatic door 13 closed to ensure the safety in supply of the sheet bundle Ps and reserves the movement path of the carrier 11 loading the sheet bundle Ps.

Figure 6:
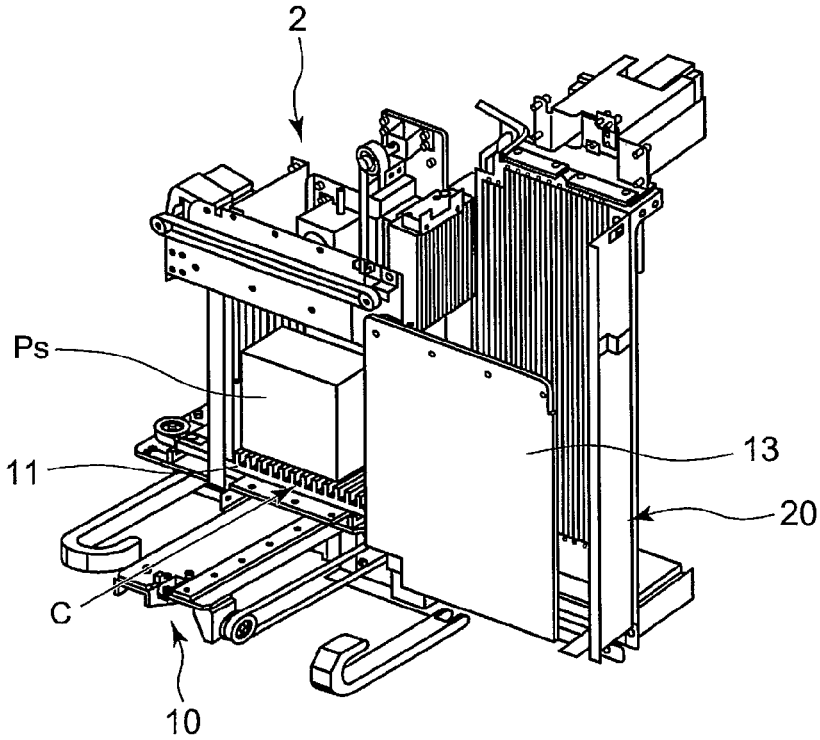
FIG. 6 is a perspective view showing the state that in FIG. 5, the carrier loading a sheet bundle moves toward the back side shown by the arrow C drawn.

As shown in FIG. 6, the carrier 11 loading the sheet bundle Ps in the empty space formed due to movement of the second automatic door 13 moves in the direction of the arrow C drawn.

Figure 7:
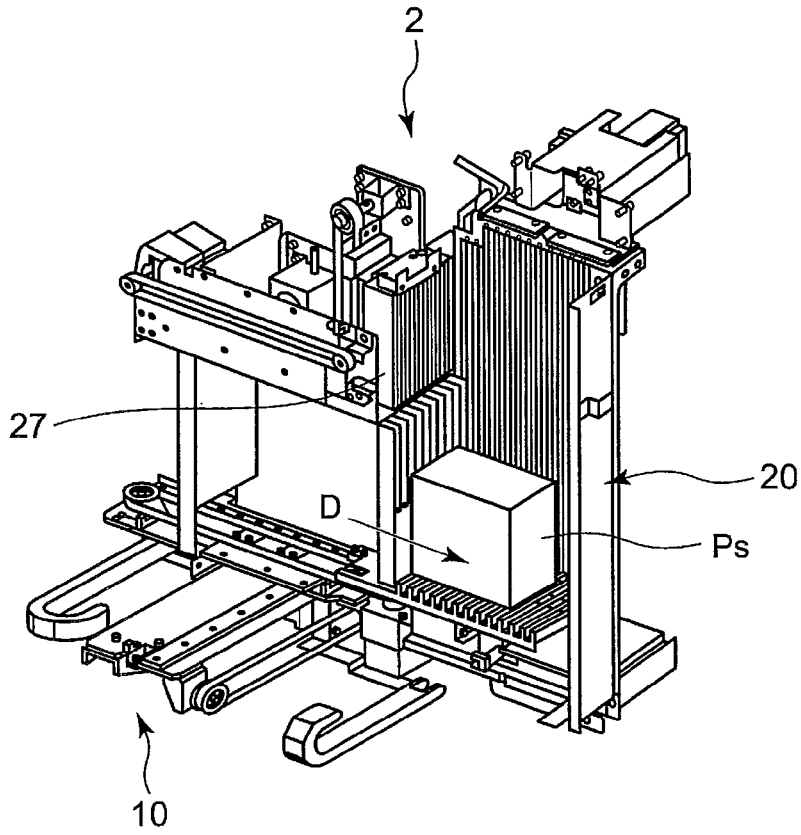
FIG. 7 is a perspective view showing the state that in FIG. 6, the carrier loading a sheet bundle moves in the direction of the arrow D drawn.

As shown in FIG. 7, the carrier 11 moves in the direction of the arrow D drawn. Then, a sheet bundle guide 27 moves down. The above mentioned is a schematic operation of the carrier 11 from loading the sheet bundle Ps on the carrier 11 to transfer to the take-out portion 20.

Figure 9:
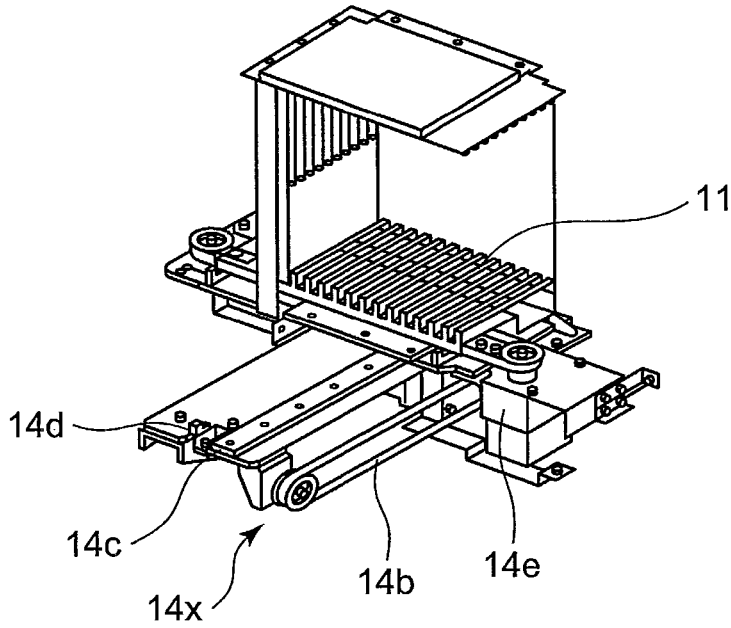
FIG. 9 is a perspective view showing the drive means for driving the carrier and the state that the carrier moves toward the back side from the state shown in FIG. 8.
Figure 10:
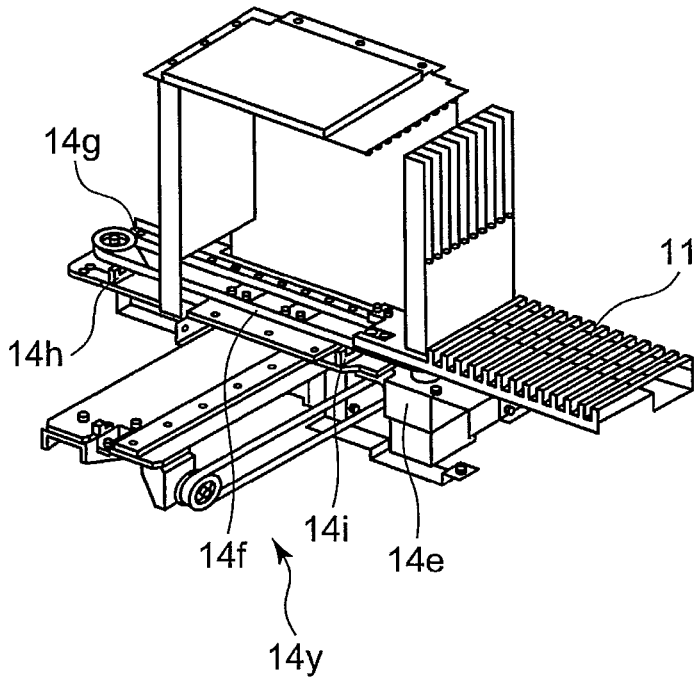
FIG. 10 is a perspective view showing the drive means for driving the carrier and the state that the carrier moves in the right direction drawn from the state shown in FIG. 9.

Next, by referring to FIGS. 8 to 10, the first moving structure 11*a* for moving the carrier 11 will be explained.

Figure 8:
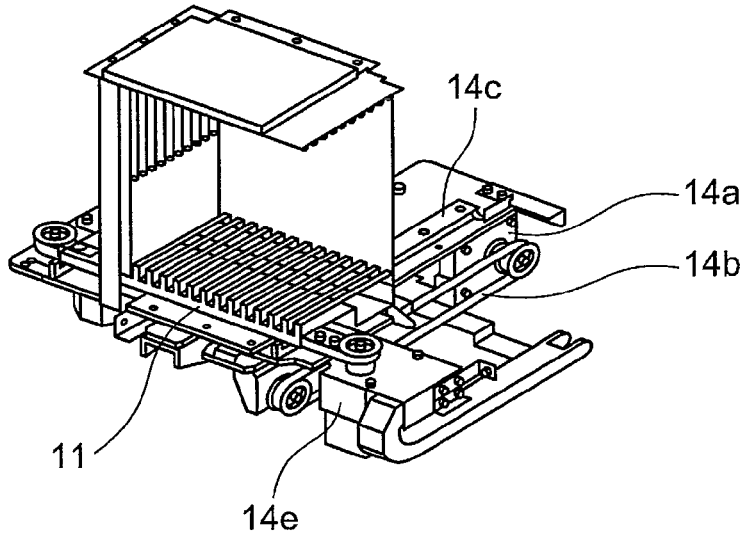
FIG. 8 is a perspective view showing the drive means for driving the carrier and the state that the carrier is positioned at the supply portion.

FIG. 8 shows the state that the carrier 11 is positioned at the supply portion 10 (the home position). FIG. 9 shows the state that the carrier 11 moves from the state shown in FIG. 8 in the back direction. Further, FIG. 10 shows the state that the carrier 11 moves in the right direction in the drawing. The carrier 11, like this, can move in the front-back direction by the first moving structure 11*a* and then move in the horizontal direction. Next, the structure of the first moving structure 11*a* will be explained.

The first moving structure 11*a* is composed of a front-back direction moving structure 14*x* and a lateral direction moving structure 14*y*. The front-back direction moving structure 14*x* is composed of a front-back direction drive motor 14*a* and a drive belt 14*b* connected to the front-back direction drive motor 14*a* via the pulley. The carrier 11 pressed by the drive belt 14*b* can move in the front-back direction along a front-back direction slide rail 14*c*. Further, the carrier 11, when it returns, must stop on the front side (the home position) and the stop position is set by a front side position sensor 14*d*.

The front side stop position is fixed by the front side position sensor 14*d*, though the back direction stop position depends upon a carrier back side position sensor 25 (refer to FIG. 18) attached to a back wall 24 which will be described later. Therefore, if the position of the back wall 24 is varied due to the sheet size, the position of the carrier back side position sensor 25 is varied and the stop position of the carrier 11 is also varied.

The horizontal direction moving structure 14*y* is composed of a horizontal direction drive motor 14*e* and a drive belt 14*f* connected to the horizontal direction drive motor 14*e* via the pulley. The carrier 11 pressed by the drive belt 14*f* can move in the horizontal direction along a horizontal direction slide rail 14*g*. The carrier 11 moving in this way is detected by a leftward stopping place sensor 14*h* and a rightward stopping place sensor 14*i*. The leftward and rightward stopping places depend upon the respective leftward and rightward stopping place sensors.

Figure 11:
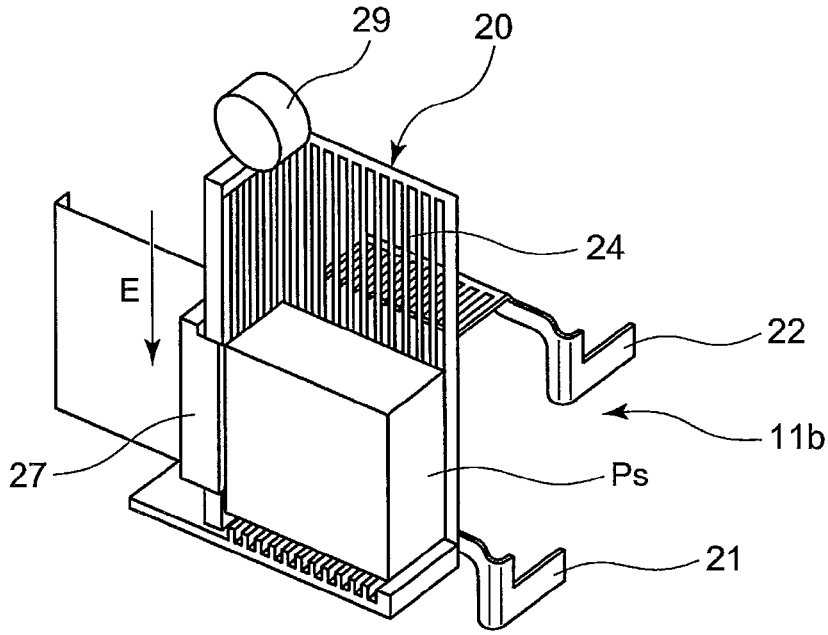
FIG. 11 is a perspective view showing the state that the sheet bundle guide goes down in FIG. 7.

The sheet bundle Ps is transferred from the supply portion 10 to the take-out position 20 by the structure described above. If the sheet bundle Ps is transferred in the right direction in this way, the sheet bundle guide 27 goes down in the direction of the arrow E drawn (FIG. 11). Further, the drive structure for driving the sheet bundle guide 27 will be described later.

Figure 12:
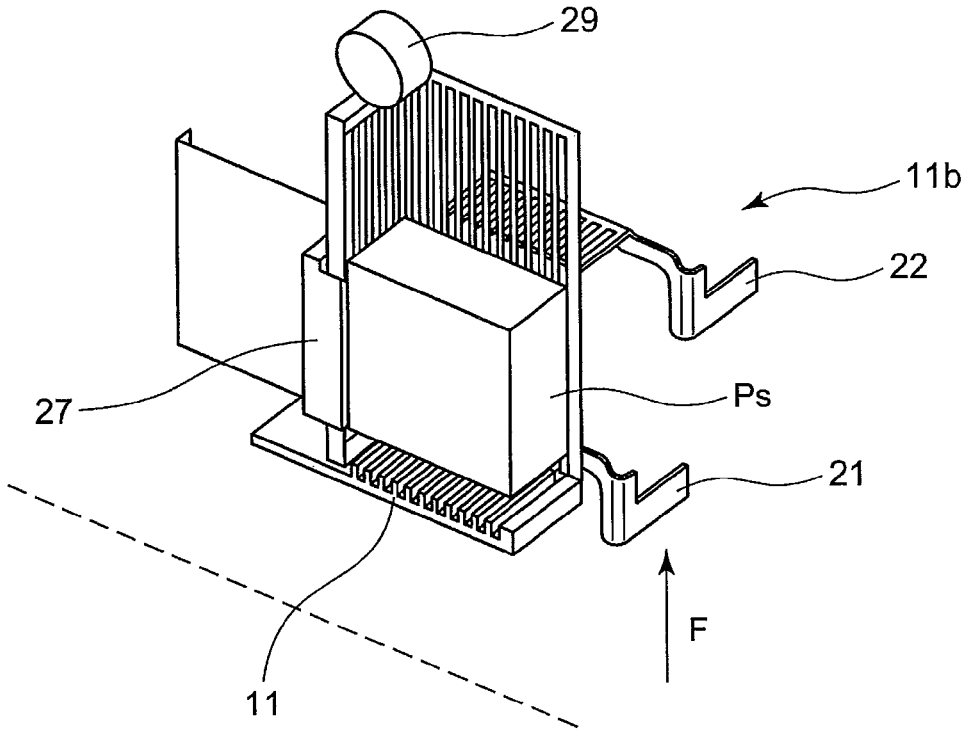
FIG. 12 is a perspective view showing the state that in FIG. 11, the sheet bundle loaded on the carrier is moved onto the backup plate and is moved in the direction of the arrow F drawn.

The sheet bundle Ps transferred in this way, when a first backup plate 21 moves up in the direction of the arrow F drawn by a second moving structure 11*b*, is moved from the carrier 11 whereon the sheet bundle Ps is loaded to the first backup plate 21 (FIG. 12).

Figure 13:
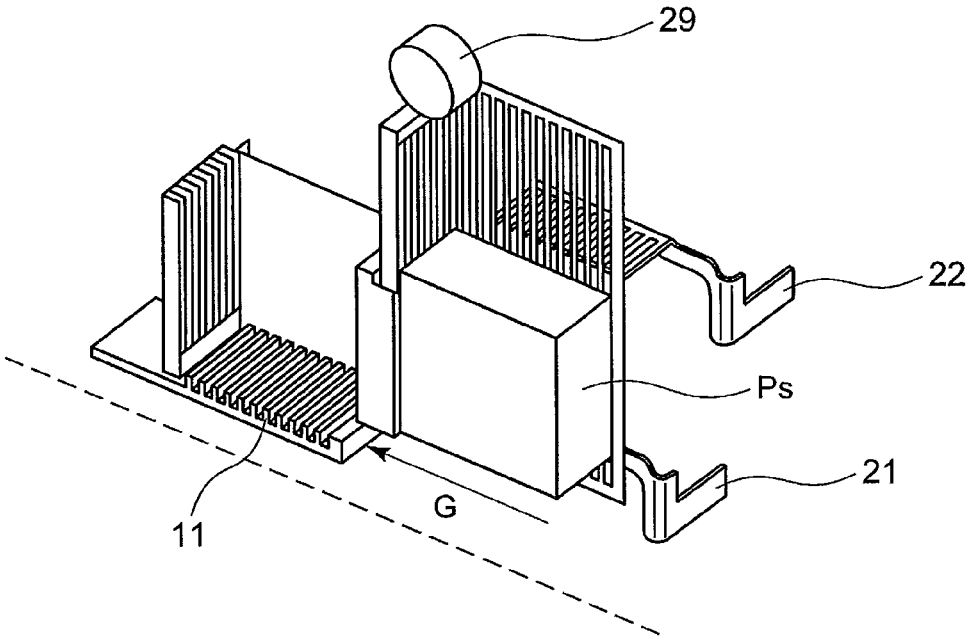
FIG. 13 is a perspective view showing the state that in FIG. 2, the free carrier is moved in the direction of the arrow G drawn.

The carrier 11 which becomes free due to shifting of the sheet bundle Ps moves in the direction of the arrow G drawn (FIG. 13). Furthermore, the carrier 11 moves in the direction of the arrow H drawn, thereby returns to the home position (FIG. 14).

Figure 14:
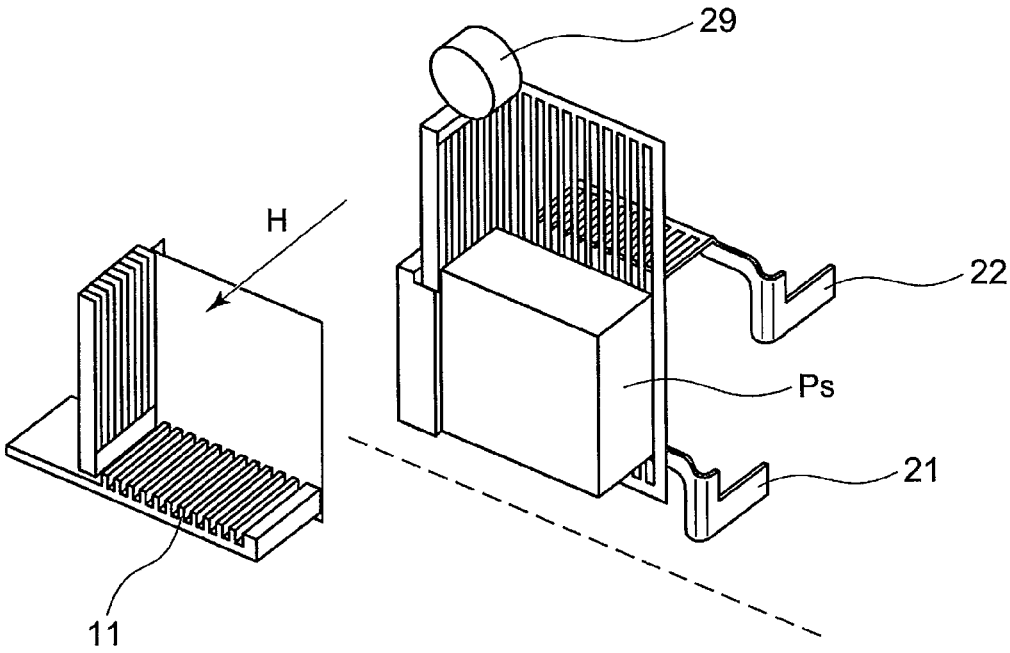
FIG. 14 is a perspective view showing the state that in FIG. 13, the carrier moves in the direction of the arrow H drawn, thereby returns to the home position.
Figure 15:
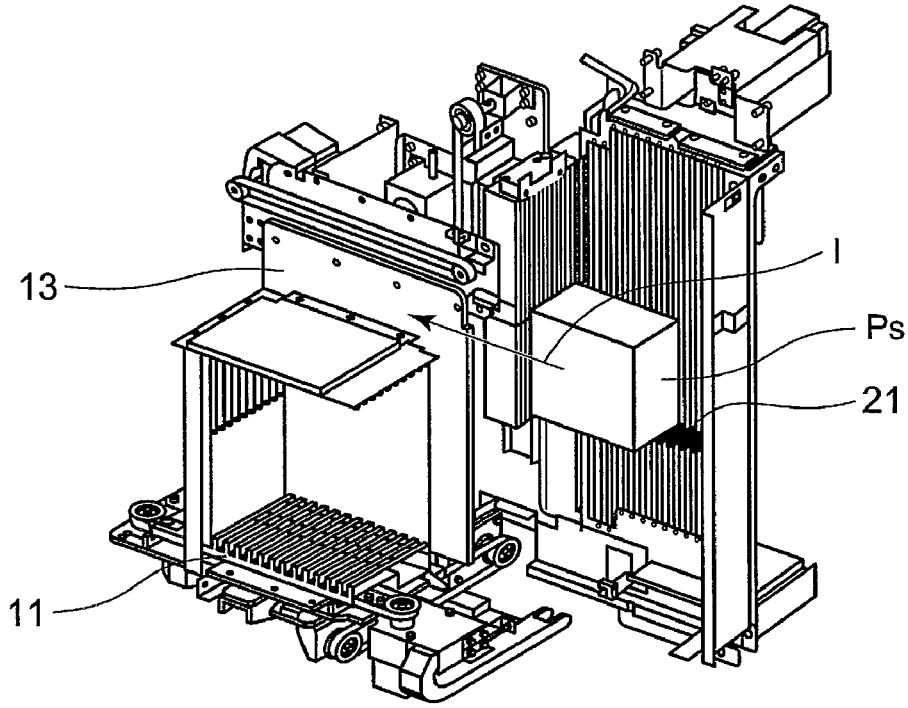
FIG. 15 is a perspective view showing the state that in FIG. 14, the carrier returns to the home position, thus the automatic door (the second automatic door) moves in the direction of the arrow I drawn.

As shown in FIG. 15, the carrier 11 shown in FIG. 14 returns to the home position, thus the second automatic door 13 moves in the direction of the arrow I drawn, and the carrier 11 can receive the next sheet bundle. In parallel with the operation, the sheet bundle Ps moves up in the state that the sheet bundle Ps is loaded in the backup plate 21 of the take-out portion 20 and stops when the sheet P on the uppermost surface of the sheet bundle Ps reaches the tack-out position by the take-out rotor (take-out structure) 29. If the sheet P is taken out by the take-out rotor 29, the position of the backup plate 21 is controlled so that the sheet P on the uppermost surface always reaches the take-out position.

Figure 16:
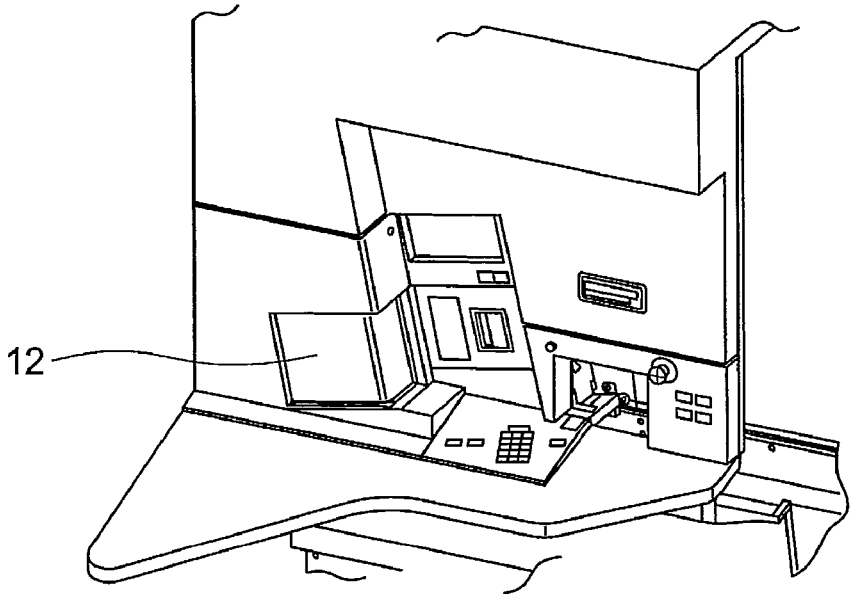
FIG. 16 is a perspective view showing the state that the automatic door (the first automatic door) under operation inside the supply portion is closed.

FIG. 16 is a condition diagram under the above processing. As shown in the drawing, the first automatic door 12 is closed. As a result, the problems such as (1) Problem of operability, (2) Problem of safety, and (3) Problem of noise can be solved. Namely, for (1) Problem of operability and (3) Problem of noise, the take-out portion 10 of the sheet bundle Ps is arranged in the neighborhood of the operator, and the supplied sheet bundle Ps is conveyed into the apparatus by the carrier 11, and then the sheets are taken out, thus an effect of reduction in noise can be obtained. Further, for (2) Problem of safety, the supply portion 10 of sheets and the take-out portion 20 of sheets are separated from each other, and in the supply portion 10 of sheets, the operation portion such as the take-out portion 20 of sheets is not arranged, and the door of the supply portion 10 of the sheet bundle Ps is made automatic, thus a structure which cannot be opened independently by the operator is obtained.

By realization of the above constitution, the problems of (1) to (3) can be solved.

Figure 17:
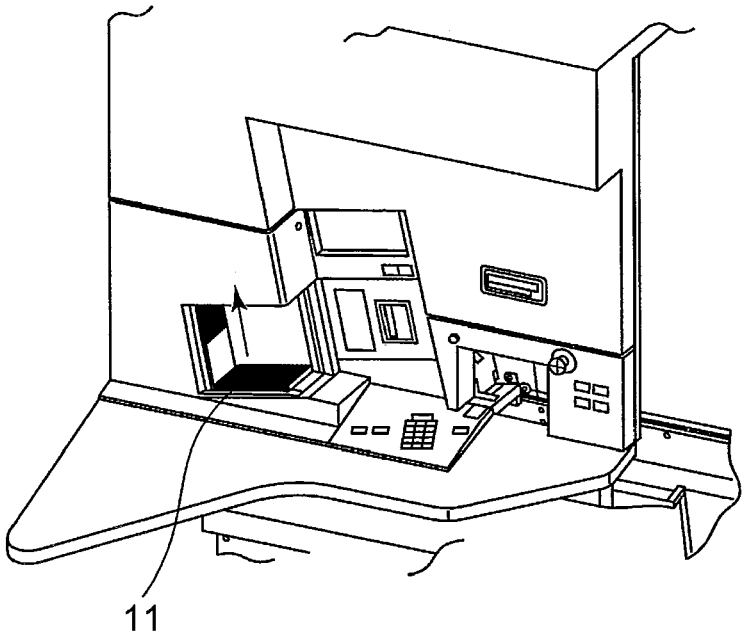
FIG. 17 is a perspective view showing the state that the carrier returns to the initial state, and the automatic door (the first automatic door) is opened, and the next sheet bundle can be supplied.

In FIG. 17, the carrier 11 and the first automatic door 12 return to the initial state by the process shown in FIG. 15, and if the next sheet bundle Ps can be supplied, the first automatic door 12 is opened, thus the next sheet bundle can be received. Further, even in this state, the take-out process of the preceding sheet bundle Ps is continued.

Figure 18:
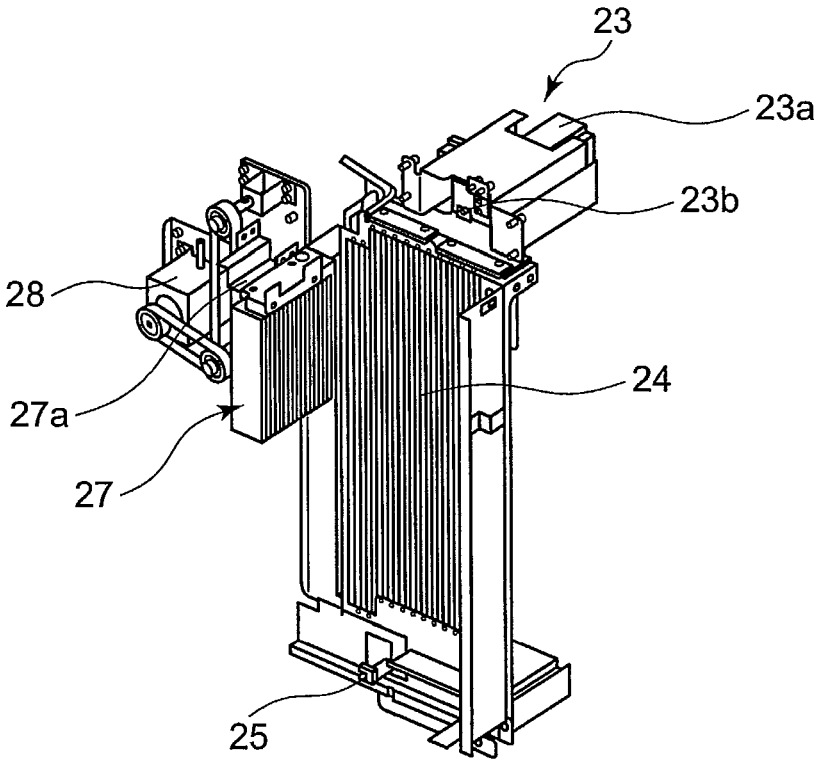
FIG. 18 is a perspective view for explaining the operations of the back wall position setting structure of the take-out portion and sheet bundle guide.

FIG. 18 is a drawing for explaining the operations of the back wall position setting structure 23 of the take-out portion 20 and the sheet bundle guide 27. In this embodiment, the carrier 11 moves, so that the loading position when transferring the sheet bundle Ps loaded on the carrier 11 to the backup plate 21 or 22 is important. With respect to the loading position, when the sheets loaded on the backup plate 21 or 22 are taken out by the take-out rotor 29 and are conveyed on the conveying path (not drawn) in the sheet processing apparatus 1, the sheets are preferably conveyed so that the conveying center of the sheets coincides with the conveying center of the conveying path.

In the drawing, the back wall 24, on the basis of the conveyance standard conveying base (not drawn) which is a conveyance standard of the sheet processing apparatus 1, can move in the front-back direction by the back wall position setting structure 23. The reason is that since the sheet size handled may depend on the kind (bill kind) of the sheets, even if the size of the bill kind (in this case, the short side size of the sheets) is changed, the center of the sheets in the short side direction is set so as to be at a fixed distance from the conveying base. Namely, according to the size of the sheets, the position of the back wall 24 is set by the back wall position setting structure 23.

The back wall position setting structure 23 is composed of a front-back direction drive motor 23*a* and a ball screw 23*b* connected to the front-back direction drive motor 23*a*, and when the front-back direction drive motor 23*a* rotates in the forward direction, can shift the back wall 24 forward in the front direction, and when the front-back direction drive motor 23*a* rotates in the backward direction, can shift the back wall 24 backward in the back direction.

The sheet bundle guide 27 is incorporated vertically movably in the back wall 24 and if the back wall 24 moves in the front-back direction, the sheet bundle guide 27 also moves in the front-back direction.

A sheet bundle guide drive motor 28 is attached to the conveying base and the timing belt and idle roller are also attached to the conveying base. The sheet bundle guide 27, even if the back wall 24 moves in the front-back direction, can move by the sheet bundle guide moving structure.

Figure 19:
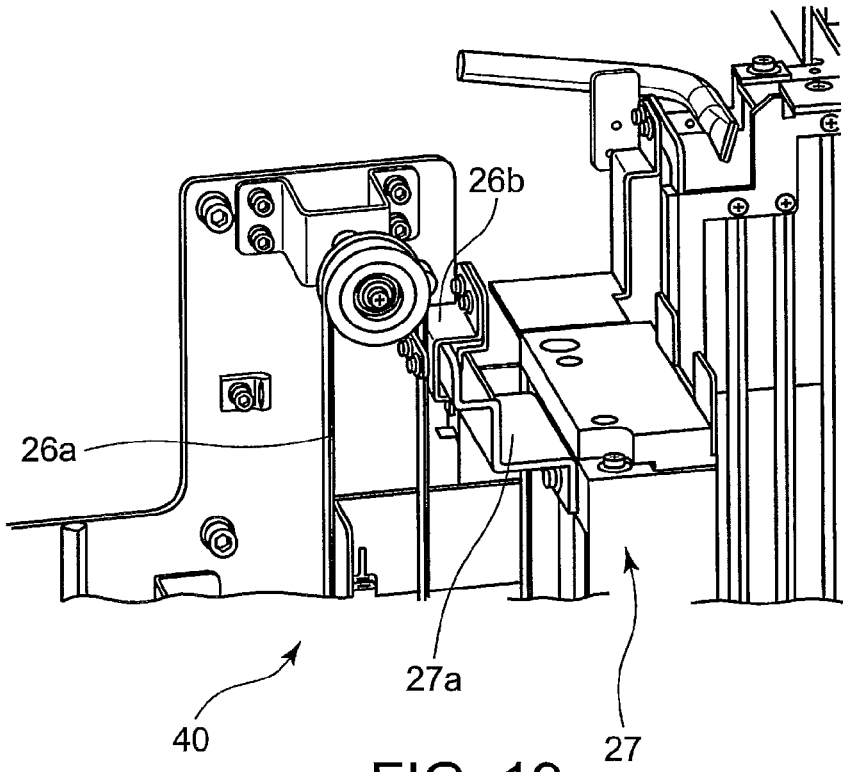
FIG. 19 is a perspective view for explaining the sheet bundle guide moving structure shown in FIG. 18.

FIG. 19 is a drawing for explaining a sheet bundle guide moving structure 40 shown in FIG. 18. The sheet bundle guide moving structure 40 is composed of the sheet bundle guide drive motor 28, a timing belt 26*a* for transferring the drive force of the sheet bundle guide drive motor 28, and a timing belt side clasp 26*b* attached to the timing belt 26*a*. If the sheet bundle guide drive motor 28 is driven to rotate in the forward and backward directions, the timing belt side clasp 26*b* also moves in the vertical direction via the timing belt 26*a*.

The timing belt side clasp 26*b* is formed in a concave shape, and the bottom thereof is attached to the timing belt 26*a*, and a sheet bundle side clasp 27*a* is structured so as to fit into the concavity. The sheet bundle guide 27 is attached to the sheet bundle side clasp 27*a* and the sheet bundle guide 27 moves in the vertical direction in correspondence to the movement of the timing belt side clasp 26*b* in the vertical direction.

The fitting portion of the timing belt side clasp 26*b* into the sheet bundle side clasp 27*a*, even if the sheet bundle side clasp 27*a* slides in the front-back direction (the back direction) due to the short side size of the sheets, is kept in the fitting condition. By the fitting, the difference in the size in the short side direction due to the bill kind of the sheets is absorbed.

On the back wall 24, the carrier back side position sensor 25 for detecting the back side position of the carrier 11 is arranged and the back side position of the carrier 11 is set by the carrier back side position sensor 25. Therefore, even if the back wall 24 moves front and back due to the short side size of the sheets, the carrier back side position sensor 25 moves in correspondence to the movement of the back wall 24 and the back side stop position of the carrier 11 is specified by the movement of the back wall 24.

Figure 20:
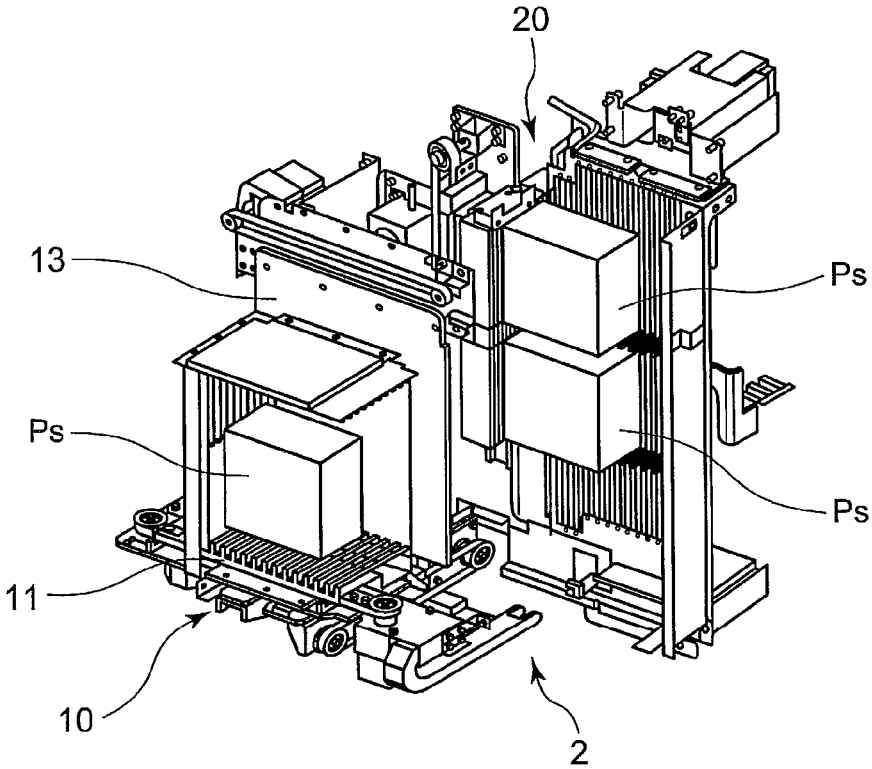
FIG. 20 is a perspective view showing the state that three sheet bundles are set in the sheet supply apparatus.

FIG. 20 shows the state that three sheet bundles Ps are supplied to the sheet supply apparatus 2. If a series of operations aforementioned is repeated, two sheet bundle Ps are loaded on the take-out portion 20 and one sheet bundle Ps is supplied to the supply portion 10. As a result, three sheet bundles Ps are supplied to the sheet supply apparatus 2. By use of such a constitution, not only the aforementioned problems of (1) to (3) are solved but also in the case of many processed sheets, the sheet supply apparatus 2 does not stop temporarily to supply the sheets and can take out the sheets almost continuously, thus the processing efficiency is improved.

As mentioned above, according to this embodiment, the sheet supply portion is separated from the take-out portion, and the supply portion is arranged in the neighborhood of the operator, and the take-out portion is installed in the apparatus away from the operator, so that a sheet supply apparatus improved in operability, safety, and noise can be provided.

What is claimed is:

1. A sheet supply apparatus comprising:

a supply portion with a sheet bundle supplied via an opening portion;

a take-out portion to move the sheet bundle supplied to the supply portion to a take-out position and take out the sheets one by one starting from a sheet on an uppermost surface of the sheet bundle;

a first door with the opening portion arranged openably to be opened when the sheet bundle is supplied to the supply portion;

a second door arranged openably on a middle position between the supply portion and the take-out position when the sheet bundle supplied to the supply portion moves to the take-out position; and a controller to control the first door and the second door to open or close, the controller controlling the first door so as to close after the sheet bundle is loaded on a carrier in the supply portion and further controlling the second door so as to open in order to permit the carrier with the sheet bundle loaded to move in a predetermined direction after the first door is closed.

2. The apparatus of claim 1 wherein the carrier moves the sheet bundle from the supply portion in a first direction, and furthermore moves the sheet bundle in a second direction perpendicular to the first direction.

3. The apparatus of claim 2, wherein the controller controls so as to move the carrier with the sheet bundle loaded in the second direction and move the sheet bundle up to the take-out portion.

4. The apparatus of claim 2 further comprising:

a back wall installed so as to decide a position where the carrier with the sheet bundle loaded moves and stops in the first direction; and a back wall position setting structure to move the back wall according to a size of the sheet bundle and set a fixed position.

5. The apparatus of claim 4, wherein the back wall position setting structure includes:

a drive source; and a ball screw having one end connected to the drive source and the other end connected to the back wall to move forward or backward the back wall according to normal rotation or reverse rotation by the drive source.

6. The apparatus of claim 2 further comprising:

a backup plate to transfer the sheet bundle from the carrier and raise the sheet bundle after the carrier with the sheet bundle loaded is moved in the second direction; and a take-out structure to take out a sheet on the uppermost surface of the sheet bundle raised up to the take-out position.

7. The apparatus of claim 6, wherein the controller controls the carrier so as to move to the supply portion after the sheet bundle is transferred from the carrier to the backup plate.

8. A sheet supply method comprising:

opening a first door of a supply portion;

supplying a sheet bundle to a supply portion;

conveying the sheet bundle from the supply portion to a second door through a movement path;

opening the second door;

conveying the sheet bundle from the second door to a take-out portion along the movement path;

closing the first door; and taking out the sheets one by one starting from a sheet on an uppermost surface of the sheet bundle in the take-out portion.

9. The method of claim 8, wherein the sheet bundle loaded on a carrier moves the sheet bundle from the supply portion in a first direction and furthermore moves the sheet bundle in a second direction perpendicular to the first direction.

10. The method of claim 9, wherein the first door is closed after the sheet bundle is loaded on the carrier positioned on the supply portion.

11. The method of claim 10, wherein the second door is opened so as to permit the carrier with the sheet bundle loaded to move in the first direction after the first door is closed.

12. The method of claim 11, wherein the carrier with the sheet bundle loaded moves in the second direction and moves the sheet bundle up to the take-out portion.

13. The method of claim 9 further comprising:

moving the carrier with the sheet bundle loaded in the first direction and stopping the carrier at a position of a back wall; and moving the back wall according to a size of the sheet bundle and setting a fixed position of the back wall.

14. The method of claim 9 further comprising:

transferring the sheet bundle from the carrier with the sheet bundle loaded onto a backup plate after the carrier moves in the second direction;

raising the backup plate up to a take-out position; and taking out a sheet on an uppermost surface of the sheet bundle rising up to the take-out position.

15. The method of claim 14 further comprising:

moving the carrier to the supply portion after the sheet bundle is transferred from the carrier to the backup plate.

* * * * *